US009923308B2

(12) United States Patent
Holland

(10) Patent No.: US 9,923,308 B2
(45) Date of Patent: Mar. 20, 2018

(54) COAXIAL CONNECTOR WITH PLUNGER

(71) Applicant: Holland Electronics, LLC, Ventura, CA (US)

(72) Inventor: Michael Holland, Santa Barbara, CA (US)

(73) Assignee: Holland Electronics, LLC, Ventura, CA (US)

( * ) Notice: Subject to any disclaimer, the term of this patent is extended or adjusted under 35 U.S.C. 154(b) by 0 days.

(21) Appl. No.: 15/698,501

(22) Filed: Sep. 7, 2017

(65) Prior Publication Data

US 2017/0373443 A1 Dec. 28, 2017

Related U.S. Application Data

(63) Continuation-in-part of application No. 15/482,727, filed on Apr. 8, 2017, which is a continuation of application No. 14/488,202, filed on Sep. 16, 2014, now Pat. No. 9,627,814, which is a continuation-in-part of application No. 13/913,487, filed on Jun. 9, 2013, now Pat. No. 9,136,629, which is a continuation-in-part of application No. 13/911,032, filed on Jun. 5, 2013, now Pat. No. 9,130,288, application No. 15/698,501, which is a continuation-in-part of application No. 15/644,734, filed on Jul. 7, 2017, which is a continuation-in-part of application No. 14/957,179, filed on Dec. 2, 2015, now Pat. No. 9,711,919, which is a continuation-in-part of application No. 14/588,889, filed on Jan. 2, 2015, now Pat. No. 9,246,275, which (Continued)

(51) Int. Cl.

| | |
|---|---|
| ***H01R 9/05*** | (2006.01) |
| ***H01R 13/6581*** | (2011.01) |
| ***H01R 24/52*** | (2011.01) |
| ***H01R 13/08*** | (2006.01) |
| *H01R 13/453* | (2006.01) |
| *H01R 103/00* | (2006.01) |
| *H01R 24/54* | (2011.01) |

(52) U.S. Cl.

CPC ..... *H01R 13/6581* (2013.01); *H01R 13/08* (2013.01); *H01R 24/525* (2013.01); *H01R 13/4538* (2013.01); *H01R 24/54* (2013.01); *H01R 2103/00* (2013.01); *Y10T 29/49208* (2015.01)

(58) Field of Classification Search

CPC ..... H01R 13/6581; H01R 2103/00; H01R 13/4538; H01R 24/54; H01R 24/542; H01R 24/44; H01R 24/525; H01R 13/08; Y10T 29/49208

See application file for complete search history.

(56) References Cited

U.S. PATENT DOCUMENTS

| | | | |
|---|---|---|---|
| 4,275,946 | A | 6/1981 | Manina et al. |
| 4,633,048 | A | 12/1986 | Komatsu |

(Continued)

FOREIGN PATENT DOCUMENTS

| | | | |
|---|---|---|---|
| EP | 1895625 | A1 | 3/2008 |
| GB | 2314465 | A | 12/1997 |

*Primary Examiner* — Jean F Duverne

(74) *Attorney, Agent, or Firm* — Paul D. Chancellor; Ocean Law

(57) ABSTRACT

An electrical connector for use with coaxial cables includes a plunger urged to protrude from a case by a spring.

14 Claims, 18 Drawing Sheets

Related U.S. Application Data is a continuation-in-part of application No. 14/069,221, filed on Oct. 31, 2013, now Pat. No. 9,178,317, which is a continuation-in-part of application No. 13/712,828, filed on Dec. 12, 2012, now abandoned.

(60) Provisional application No. 61/620,355, filed on Apr. 4, 2012, provisional application No. 61/717,595, filed on Oct. 23, 2012, provisional application No. 61/673,356, filed on Jul. 19, 2012.

(56) References Cited

U.S. PATENT DOCUMENTS

| | | | |
|---|---|---|---|
| 4,660,921 | A | 4/1987 | Hauver |
| 5,175,493 | A | 12/1992 | Langgard |
| 5,329,262 | A | 7/1994 | Fisher |
| 5,516,303 | A | 5/1996 | Yohn |
| 5,598,132 | A | 1/1997 | Stabile |
| 5,632,637 | A | 5/1997 | Diener |
| 5,746,619 | A | 5/1998 | Harting |
| 5,820,390 | A | 10/1998 | Takamoto et al. |
| 5,921,793 | A | 7/1999 | Phillips |
| 6,019,622 | A | 2/2000 | Takahashi et al. |
| 6,113,431 | A | 9/2000 | Wong |
| 6,270,367 | B1 | 8/2001 | Bussard |
| 6,276,970 | B1 | 8/2001 | Wong |
| 6,329,251 | B1 | 12/2001 | Wu |
| 6,712,631 | B1 | 3/2004 | Youtsey |
| 6,716,062 | B1 | 4/2004 | Palinkas et al. |
| 7,442,084 | B2 | 10/2008 | Montena |
| 7,753,705 | B2 | 7/2010 | Montena |
| 7,934,954 | B1 | 5/2011 | Chawgo et al. |
| 7,938,680 | B1 | 5/2011 | Hsieh |
| 8,272,893 | B2 | 9/2012 | Burris et al. |
| 8,556,656 | B2 | 10/2013 | Thomas et al. |
| 8,602,818 | B1 | 12/2013 | Chawgo et al. |
| 8,690,603 | B2 | 4/2014 | Bence et al. |
| 8,708,737 | B2 | 4/2014 | Chawgo et al. |
| 8,753,147 | B2 | 6/2014 | Montena |
| 8,758,050 | B2 | 6/2014 | Montena |
| 8,888,527 | B2 | 11/2014 | Chastain et al. |
| 9,130,288 | B2 | 9/2015 | Holland |
| 9,136,629 | B2 | 9/2015 | Holland |
| 9,178,317 | B2 | 11/2015 | Holland |
| 9,246,275 | B2 * | 1/2016 | Holland ..... H01R 24/44 |
| 9,407,050 | B2 | 8/2016 | Holland |
| 9,444,197 | B2 * | 9/2016 | Goebel ..... H01R 13/6581 |
| 9,490,592 | B2 * | 11/2016 | Chastain ..... H01R 24/542 |
| 9,647,394 | B2 * | 5/2017 | Goebel ..... H01R 13/6581 |
| 9,711,919 | B2 * | 7/2017 | Holland ..... H01R 24/44 |
| 2003/0129873 | A1 | 7/2003 | Heebe |
| 2005/0148236 | A1 | 7/2005 | Montena |
| 2007/0298653 | A1 | 12/2007 | Mahoney et al. |
| 2009/0011628 | A1 | 1/2009 | Purchon |
| 2009/0053929 | A1 | 2/2009 | Burris |
| 2009/0114424 | A1 | 5/2009 | Holland |
| 2009/0203257 | A1 | 8/2009 | Clyatt |
| 2010/0015849 | A1 | 1/2010 | Lee |
| 2010/0255721 | A1 | 10/2010 | Purdy et al. |
| 2011/0045694 | A1 | 2/2011 | Chee |
| 2011/0076885 | A1 | 3/2011 | Shaw |
| 2011/0117776 | A1 | 5/2011 | Burris et al. |
| 2011/0244720 | A1 | 10/2011 | Peng |
| 2013/0084741 | A1 | 4/2013 | Pabst et al. |
| 2013/0102190 | A1 | 4/2013 | Chastain et al. |
| 2013/0137300 | A1 | 5/2013 | Eriksen |
| 2013/0171870 | A1 | 7/2013 | Chastain |
| 2013/0266275 | A1 | 10/2013 | Holland |

* cited by examiner

COAXIAL CONNECTOR WITH PLUNGER

PRIORITY CLAIM AND INCORPORATION BY REFERENCE

This application is a continuation-in-part of Ser. No. 15/482,727 filed Apr. 8, 2017 which is a continuation of Ser. No. 14/488,202 filed Sep. 16, 2014, now U.S. Pat. No. 9,627,814, which is a countinuation-in-part of Ser. No. 13/913,487 filed Jun. 9, 2013, now U.S. Pat. No. 9,136,629, which is a continuation-in-part of Ser. No. 13/911,032 filed Jun. 5, 2013, now U.S. Pat. No. 9,130,288, which claims the benefit of provisional application 61/717,595 filed Oct. 23, 2012 and the benefit of provisional application 61/673,356 filed Jul. 19, 2012. This application is a continuation-in-part of Ser. No. 15/644,734 filed Jul. 7, 2017 which is a continuation-in-part of Ser. No. 14/957,179 filed Dec. 2, 2015, now U.S. Pat. No. 9,711,919, which is a continuation-in-part of Ser. No. 14/588,889 filed Jan. 2, 2015, now U.S. Pat. No. 9,246,275, which is a continuation-in-part of Ser. No. 14/069,221 filed Oct. 31, 2013, now U.S. Pat. No. 9,178,317, which is a continuation-in-part of Ser. No. 13/712,828, filed Dec. 12, 2012, now abandoned, which claims the benefit of provisional application 61/620,355 filed Apr. 4, 2012. All of these applications are incorporated herein by reference, in their entireties and for all purposes.

BACKGROUND OF THE INVENTION

Field of the Invention

The present invention relates to items of manufacture. A signal connector provides for making coaxial connections. More particularly, the present invention relates to a female coaxial connector that provides for isolating the center pin from radio frequency signals when one end of the connector is disconnected.

Description of the Related Art

Coaxial cable connectors that provide for isolating the center pin from transmitted or received signals when one end of the connector is disconnected are rare. Coaxial cable connectors that provide for isolating the center pin from transmitted or received signals using a movable connector nose appear virtually unknown but for applicant's contribution to the art.

SUMMARY OF THE INVENTION

Electrical connectors that handle radio frequency signals may transmit or receive electrical signals whether they are connected or not. Examples include a coaxial cable connector that radiates a signal when one side of the connector is disconnected and the other is connected to a signal source. Examples include a coaxial cable connector that receives an extraneous signal when one side of the connector is disconnected and the other is connected to a signal sink.

Female connectors are a known source of extraneous signal transfer. In various designs a female coaxial connector includes a conductive center pin or similar structure for engaging the center conductor of a male connector. This center pin may act as an antenna for sending or receiving radio frequency signals.

For example, where the connector is a splice and terminates an active coaxial cable, problems of extraneous signal transfer may arise. Here, a splice is connected to an active coaxial cable on one side and disconnected on the other. This situation may present an excited center pin that radiates a signal. The radiated signal may be received by other radio frequency equipment and adversely affect that equipment's performance.

For example the above splice may present a center pin for receiving a signal. To the extent that the center pin acts as a receiving antenna, extraneous signals may be received. These received signals may adversely affect the radio frequency equipment interconnected by the splice.

Shielding provides a solution to the problem of transmitting or receiving extraneous radio frequency signals when one end of the connector is disconnected. In essence, shielding is provided by a cover that is opaque to radio frequency signals. Metallic covers or electrically conductive covers are frequently used to reduce or prevent the unwanted transfer of electromagnetic signals.

In the case of coaxial connectors and female connectors in particular, a cover may be arranged to extend the shield around a port or center pin that is not connected.

An electrical signal connector for use with coaxial cables includes a moving nose. In an embodiment a coaxial cable connector comprises: a connector body including a center pin for receiving the center conductor of a male connector; a plunger urged by a spring to protrude from a connector body mouth at a connector body first end; opposed first and second spring ends, the first spring end resting on a spring base affixed to the body and the second spring end resting on the plunger; the spring surrounding an insulated portion of the center conductor wherein the spring is spaced apart from the insulated center conductor; a connector body second end opposite the connector body first end and a connector middle therebetween, the spring base being located between the connector first end and the connector middle; when the connector is not mated, the center pin is masked from extraneous signals, the spring is extended, and the plunger protrudes from the connector body mouth; and, when the connector is mated, the center pin receives the center conductor of a male connector, the spring is compressed, and the plunger is moved toward the second end of the connector.

BRIEF DESCRIPTION OF THE DRAWINGS

The present invention is described with reference to the accompanying figures. These figures, incorporated herein and forming part of the specification, illustrate the present invention and, together with the description, further serve to explain the principles of the invention and to enable a person skilled in the relevant art to make and use the invention.

DESCRIPTION OF THE PREFERRED EMBODIMENTS

The disclosure provided in the following pages describes examples of some embodiments of the invention. The designs, figures, and description are non-limiting examples of the embodiments they disclose. For example, other embodiments of the disclosed device and/or method may or may not include the features described herein. Moreover, described features, advantages or benefits may apply to only certain embodiments of the invention and should not be used to limit the disclosed invention.

As used herein, the term "coupled" includes direct and indirect connections. Moreover, where first and second devices are coupled, intervening devices including active devices may be located therebetween.

Figure 1A:
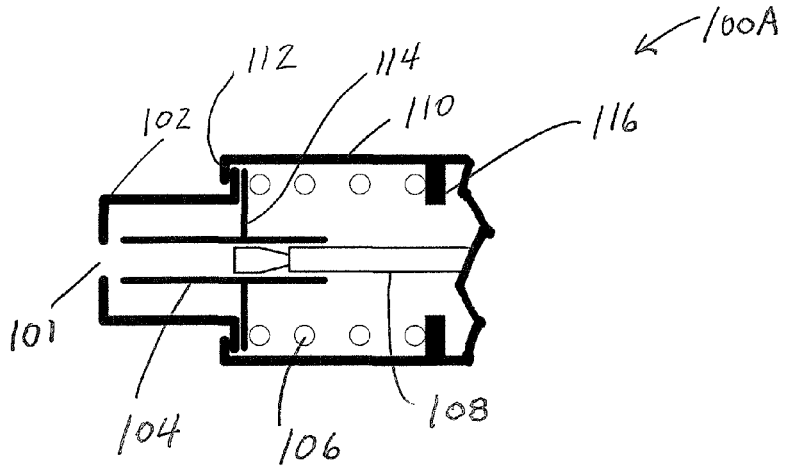
FIGS. 1A-B show a moving nose female coaxial connector of the present invention.
Figure 1B:
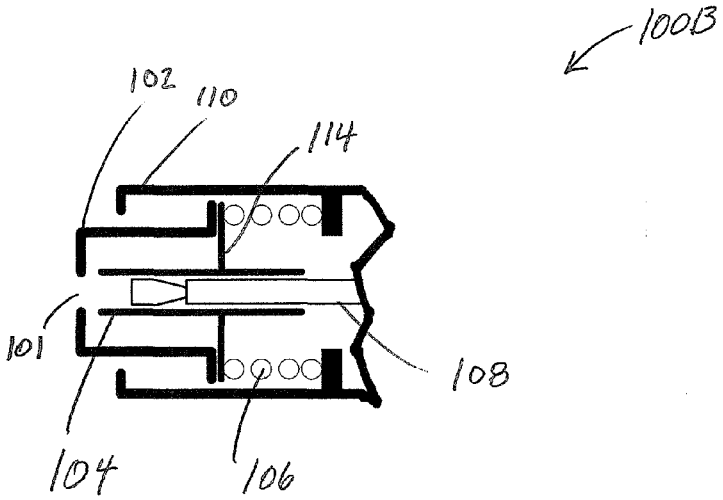

FIGS. 1A-B show a female coaxial connector with moving plunger assembly or nose 100A-B.

In particular, FIG. 1A shows a female coaxial cable connector such as an F-Type connector. A case or body 110 houses a plunger 104, a spring 106, and a center pin 108. Here and elsewhere in this patent application the case may be metallic or a non-conductor. Here and elsewhere in this patent application the spring may be metallic or a non-conductor. Here and elsewhere in this patent application the plunger may be an insulator or may include an insulator.

The plunger 104 and a cap 102 are urged to protrude from the body 110 by a spring 106. The cap is made from a material that is opaque to radio frequency signals. In various embodiments the cap is made from or includes metal or an electrical conductor.

Entryway 101 provides the center conductor of a male coaxial connector with access to the center pin 108. As shown, the body may include a feature such as an inwardly turned portion or ring 112 for retaining the cap and plunger against the force of the spring tending to push them from the body. The retainer may operate when the body feature 112 touches an outwardly turned portion or ring of the cap 114. And as shown, the spring may rest on a body internal feature such as internal ring or metallic ring 116 or on a body shoulder such as a shoulder integral with the body.

FIG. 1B shows the female coaxial connector of FIG. 1A after the cap 102 and plunger 104 are depressed compressing the spring 106 against the stop or backstop 116. Depression may be by fitment of a male coaxial connector (not shown) to the female connector 100B. Notably, both the plunger and the cap are moved as a result of fitment of a male connector. However, the plunger slides over the center pin 108 while the center pin remains at rest.

FIGS. 2A-F show moving nose female coaxial connectors and female coaxial connector parts 200A-F.

Figure 2A:
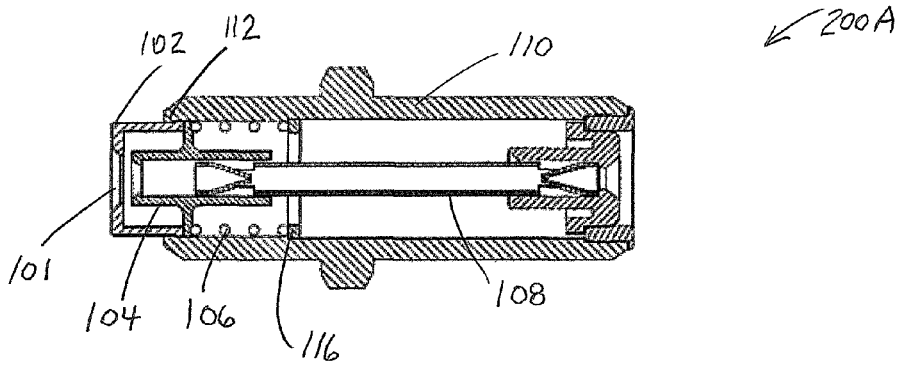
FIGS. 2A-F show an embodiment of the moving nose female coaxial connector of FIG. 1A.

In particular, FIG. 2A shows a second female coaxial cable connector splice such as an F-Type connector. A case or body 110 houses a plunger 104, a spring 106, and a center pin 108. In various embodiments the case is metallic as is the spring and the center pin. In various embodiments, the plunger is an insulator.

The plunger 104 and a cap 102 are urged to protrude from the body 110 by a spring 106. Cap materials include metals or electrical conductors. And as shown, the spring may rest on a body internal feature such as internal ring or metallic ring 116. Entryway 101 provides the center conductor of a male coaxial connector with access to the center pin 108.

Figure 2B:
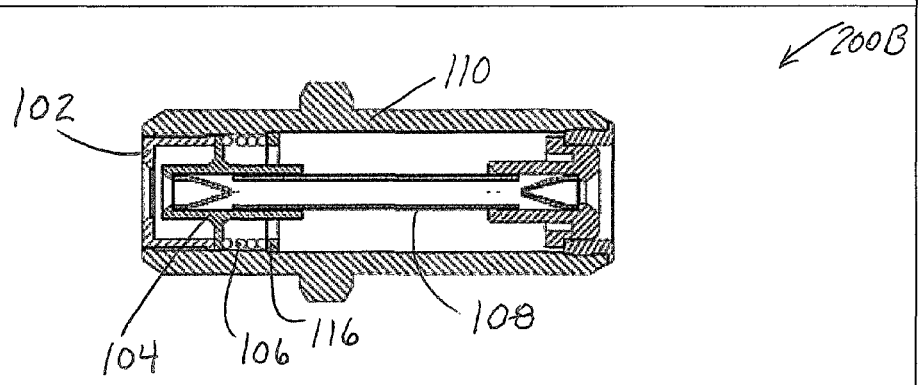

FIG. 2B shows the female coaxial connector of FIG. 2A after the cap 102 and plunger 104 are depressed compressing the spring 106 against the stop or backstop 116. Depression may be by fitment of a male coaxial connector (not shown) to the female connector 200B. Notably, both the plunger and the cap are moved as a result of fitment of a male connector. However, the plunger slides over the center pin 108 while the center pin remains at rest.

Figure 2C:
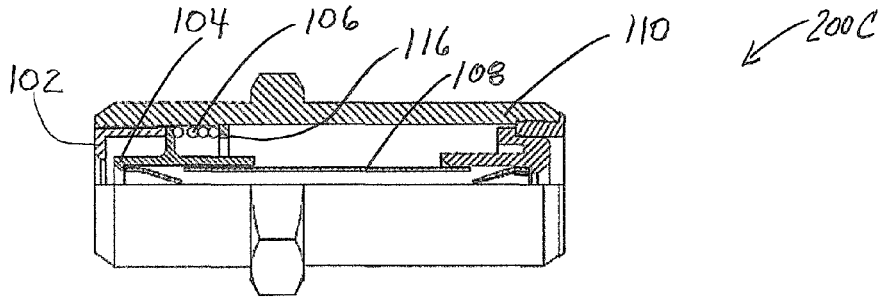

While FIGS. 2A-B show cross sectional drawings of the connector, FIG. 2C shows a one half cross-section. As shown, with respect to the body 110, the cap 102 and plunger 104 are depressed, the spring 106 is compressed against stop 116, and plunger slides over the center pin 108.

In various embodiments the aperture in the cap 205 and the aperture in the plunger 206 are related. For example, in an embodiment a cap aperture is for receiving the center conductor of a male connector and the aperture large enough to allow insertion of the male connector center conductor and small enough to mask the center conductor from extraneous radio frequency signals. For example the cap aperture has a minimum diameter that is 2 to 4 times the diameter of the male connector center conductor. For example, the center conductor entryway provides access to the center pin and includes an aperture in the cap having a diameter about equal to that of an aperture in the plunger. For example, the center conductor entryway provides access to the center pin and includes a narrowing cap aperture that adjoins a narrowing plunger aperture, the adjoining aperture diameters being the same, about the same, or differing by less than the diameter of the male connector center conductor.

Figure 2D:
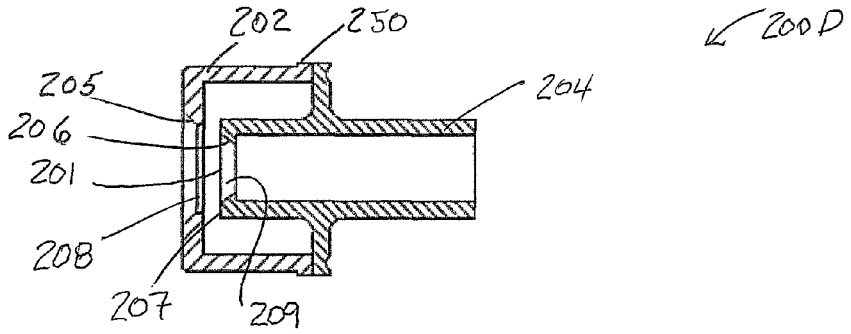
Figure 2E:
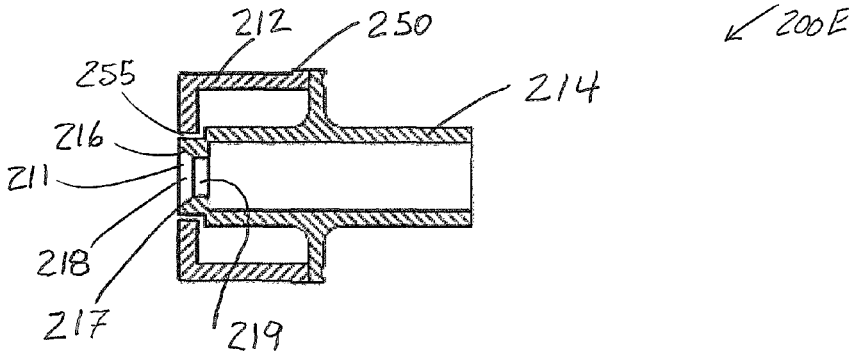
Figure 2F:
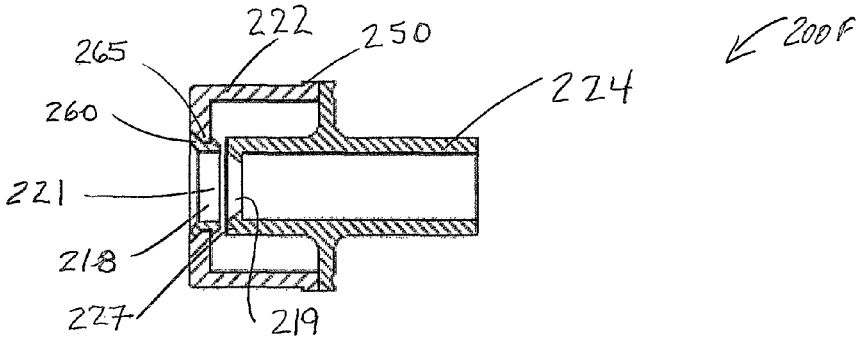

FIGS. 2D-F show alternative cap and plunger assemblies 200D-F. FIG. 2D shows a detailed view of a cap 202 and plunger 204 assembly with an entryway 201 including a passageway in the cap 208 and a passageway in the plunger 209. In various embodiments, the cap is butted against the plunger. The cap may include a feature such as an outwardly turned portion or ring 250 that mates with a case inwardly turned portion or ring 112 (see FIG. 2A) for stopping the cap from leaving the case under the influence of the spring.

As shown, the metallic cap 202 covers the front end of the plunger 207. Notably, a center conductor of a male coaxial cable (not shown) may pass through the entryway 201 to gain access to the center pin 108 (See FIG. 2A).

As shown, the metallic cap 202 passageway 208 may be chamfered 205 and the plunger 209 passageway may provide a chamfered passageway 206. In the embodiment shown, the cap passageway 205 is not insulated.

FIG. 2E shows a detailed view of a cap 212 and plunger 214 assembly with a passageway in the cap 218 and a passageway in the insulator 219. In various embodiments, the cap is butted against the plunger. An entryway 211 via passages 218, 219 in the cap and plunger provide for receiving a coaxial cable center conductor. The passageway in the plunger may be chamfered 216. The cap may include a feature such as an outwardly turned portion or ring 250 that mates with a case inwardly turned portion or ring 112 (See FIG. 2A) for stopping the cap from leaving the case under the influence of the spring.

As shown, the metallic cap 212 covers the front end of the plunger 217. Notably, a center conductor of a male coaxial cable (not shown) may pass through the entryway 211 to gain access to the center pin 108 (See FIG. 2A).

As shown, the plunger front end 217 is designed to insulate the aperture 255 of the metallic cap 212. In various embodiments, an insulated passageway into the plunger 218 is formed such that a coaxial cable center conductor/male connector center conductor inserted therein and carrying a signal cannot short against the grounded metallic cap. For example, the insulated plunger front end is inserted in the cap aperture 255, is hollow, and has a spear-like shape (as shown).

FIG. 2F shows a detailed view of a cap 222 and plunger 224 assembly with an entryway 221. In various embodiments, the cap is butted against the plunger. The entryway includes a passageway through the cap 218 and a passageway through the plunger 219. The cap may include a feature such as an outwardly turned portion or ring 250 that mates with a case inwardly turned portion or ring 112 (See FIG. 2A) for stopping the cap from leaving the case under the influence of the spring.

As shown, the metallic cap 222 covers the front end of the plunger 227. Notably, a center conductor of a male coaxial cable (not shown) may pass through the entryway 221 to gain access to the center pin 108 (See FIG. 2A).

Plunger front 227 may be designed to stop short of the cap passageway 218 and insulation of the cap aperture 265 may be with an insulator 260 that provides for guarding a coaxial cable center conductor against contact with a conductive cap which may be grounded. The aperture insulation may be total (as shown) or partial. For example, the insulator may insulate only portions of the aperture. For example the insulator may insulate portions of the cap adjacent to the aperture. And for example the insulator may be supported by a rim(s) (as shown) or by an interference fit.

FIGS. 3A-E show another connector embodiment 300A-E.

Figure 3A:
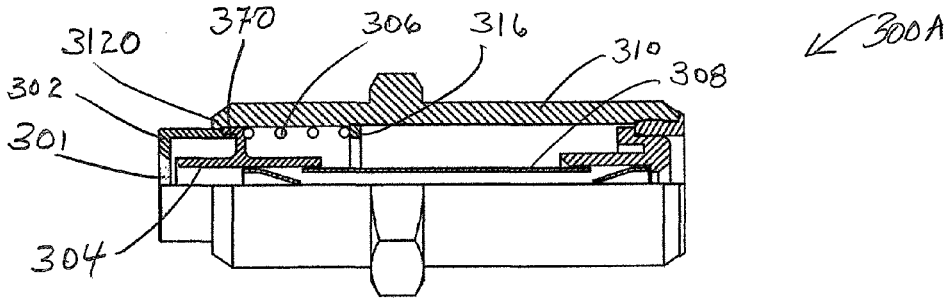
FIGS. 3A-E show another embodiment of the moving nose female coaxial connector of FIG. 1A.
Figure 3B:
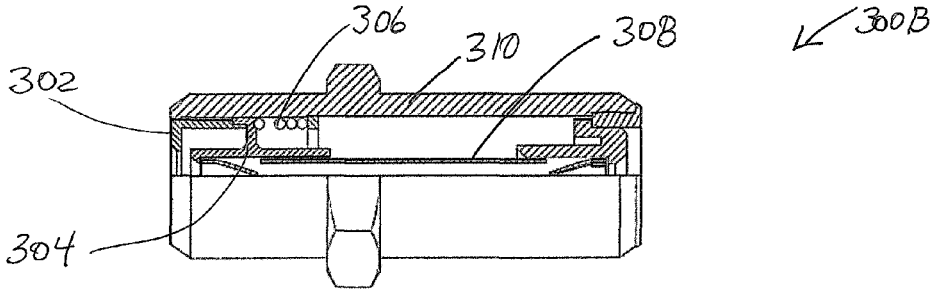
Figure 3C:
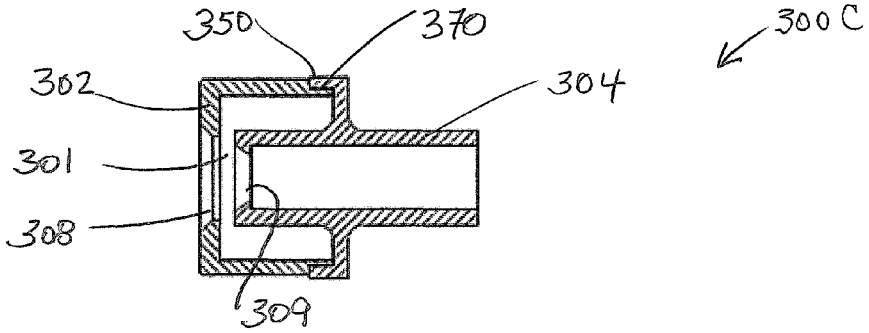

FIG. 3A, connector unmated, and FIG. 3B, connector mated, show a female coaxial cable connector such as an F-Type connector 300A-B. FIG. 3C shows a plunger 304 and cap 302 assembly where the cap includes an uninsulated aperture and the passageway into the plunger 309 is offset from the passageway into the cap 308.

In particular, a case or body 310 houses a plunger 304 encircled by a cap 302, a spring 306, and a center pin 308. Cap materials may include metals or electrical conductors. Notably, the cap 302 and the plunger 304 are fitted together 370 in an overlapping arrangement where the cap fits within the plunger in a telescopic arrangement. Here and elsewhere in this patent application the case 310 may be metallic or a non-conductor. Here and elsewhere in this patent application the spring 306 may be metallic or a non-conductor. Here and elsewhere in this patent application the plunger may be an insulator or may include an insulator.

The plunger 304 and cap 302 are urged to protrude from the body 310 by a spring 306. Notably, in FIG. 3B the plunger and cap are pushed into the body 310 when the connector is mated. Entryway 301 provides the center conductor of a male coaxial connector with access to the center pin 308. As shown, the body 310 may include a feature such as an inwardly turned portion or ring 3120 for retaining the cap and plunger against the force of the spring tending to push them from the body. The retainer may operate when the body feature 312 touches an outwardly turned portion or ring of the cap 350 (See FIG. 3C). And as shown, the spring may rest on a body internal feature such as internal ring or metallic ring 316 or on a body shoulder such as an integral shoulder.

Figure 3D:
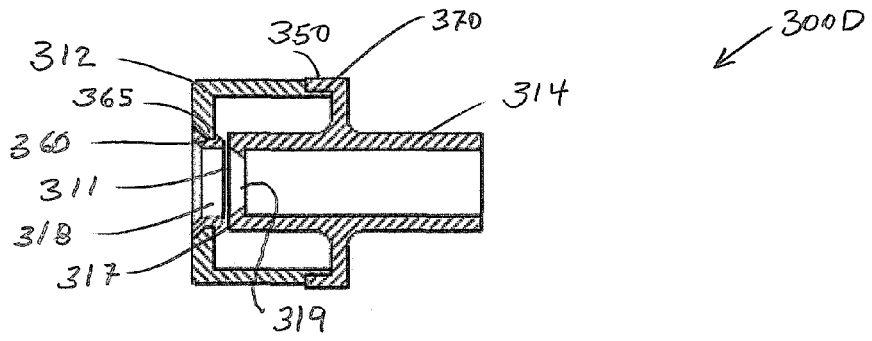
Figure 3E:
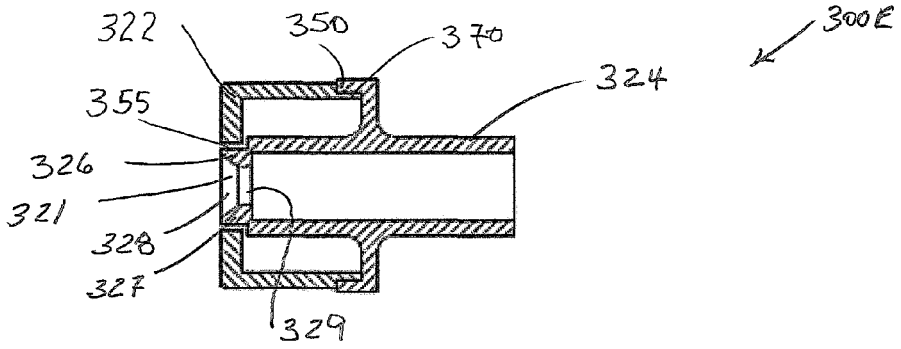

FIGS. 3D-E show alternative cap and plunger assemblies for moving nose connectors 300D-E.

FIG. 3D shows a detailed view of a cap 312 and plunger 314 assembly with an entryway 311. Notably, the cap and the plunger are fitted together 370 in an overlapping arrangement wherein the cap may fit within the plunger in a telescopic arrangement.

An entryway 311 includes a passageway through the cap 318 and a passageway through the plunger 319. The cap may include a feature such as an outwardly turned portion or ring 350 that mates with a case inwardly turned portion or ring 312 (See FIG. 3A) for stopping the cap from leaving the case under the influence of the spring.

As shown, the metallic cap 312 covers the front end of the plunger 317. Notably, a center conductor of a male coaxial cable (not shown) may pass through the entryway 311 to gain access to the center pin 308 (See FIG. 3A).

Plunger front 317 may be designed to stop short of the cap passageway 318 and insulation of the cap aperture 365 may be with an insulator 360 that provides for guarding a coaxial cable center conductor against contact with a conductive cap which may be grounded. The aperture insulation may be total (as shown) or partial. For example, the insulator may insulate only portions of the aperture. For example the insulator may insulate portions of the cap adjacent to the aperture. And for example the insulator may be supported by a rim(s) (as shown) or by an interference fit.

FIG. 3E shows a detailed view of a cap 322 and plunger 324 assembly with a passageway in the cap 328 and a passageway in the plunger 329. Notably, the cap and the plunger are fitted together 370 in an overlapping arrangement wherein the cap may fit within the plunger in a telescopic arrangement.

An entryway 321 via passages 318, 319 in the cap and plunger provide for receiving a coaxial cable center conductor. The passageway in the plunger may be chamfered 326. The cap may include a feature such as an outwardly turned portion or ring 350 that mates with a case inwardly turned portion or ring 3120 (See FIG. 3A) for stopping the cap from leaving the case under the influence of the spring.

As shown, the cap 322 covers the front end of the plunger 327. Notably, a center conductor of a male coaxial cable (not shown) may pass through the entryway 321 to gain access to the center pin 308 (See FIG. 3A).

As shown, the plunger front end 327 is designed to insulate the aperture 355 of the metallic cap 322. In various embodiments, an insulated passageway into the plunger 328 is formed and such that a coaxial cable center conductor/male connector center conductor inserted therein and carrying a signal cannot short against the grounded metallic cap. For example, the insulated plunger front end is inserted in the cap aperture 355, is hollow, and has a spear-like shape (as shown). Various embodiments provide for an insulated aperture where there is a gap, such as an annular gap, between the plunger front end 327 and the cap aperture 355. Various embodiments provide for an insulated aperture where there is no gap, such as an annular gap, between the plunger front end 327 and the cap aperture 355.

FIGS. 4A-H show a moving nose female coaxial connector with a modified plunger 400A-H. Plunger materials include insulators. As will become evident, the plunger of this connector interfaces with the cap along two generally opposed arcs such that there is a semicircular engagement or interengagement. Cap materials include metals or electrical conductors.

Figure 4A:
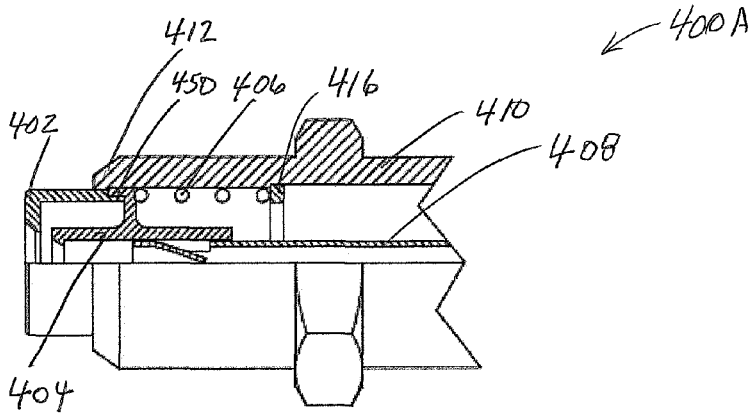
FIGS. 4A-H show another embodiment of the moving nose female coaxial connector of FIG. 1A.
Figure 4B:
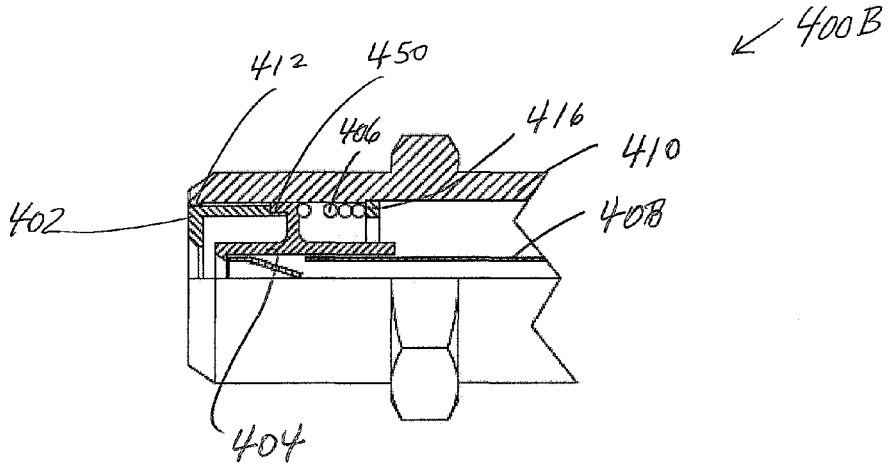

FIG. 4A, connector unmated, and FIG. 4B, connector mated, show a female coaxial cable connector such as an F-Type connector 400A-B. In each of the figures, a cap 402 interfaces with a plunger 404 that receives and slides along a connector center conductor 408. A spring 406 rests against a stop or body stop 416 and exerts a force on the plunger 404 directly or indirectly such that the cap and plunger tend to extend from the connector body 410. A body ring or rim 412 at a body mouth may contact a raised surface 450 of the cap and plunger assembly to stop the cap and plunger assembly from being pushed completely from the body.

Not visible in the FIGS. 4A-B is the semicircular interengagement of the cap 402 and the plunger 404. This feature becomes visible in the figures which follow.

Figure 4C:
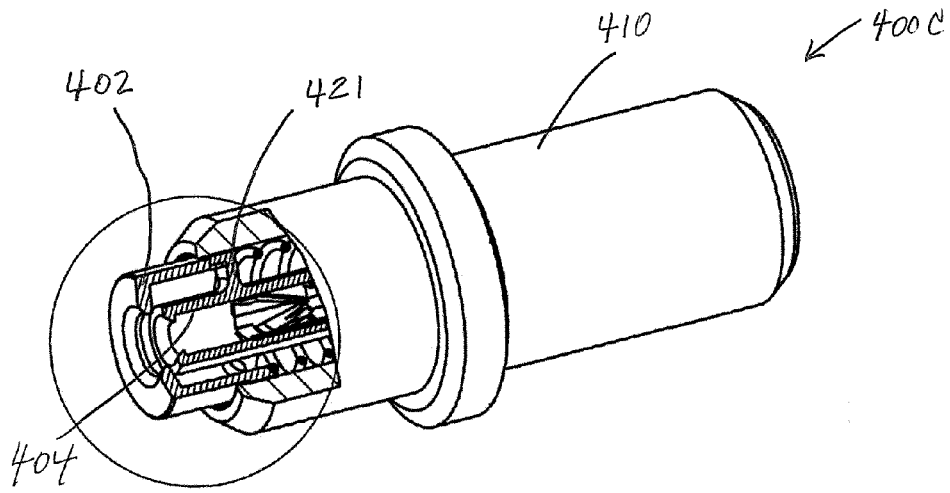
Figure 4D:
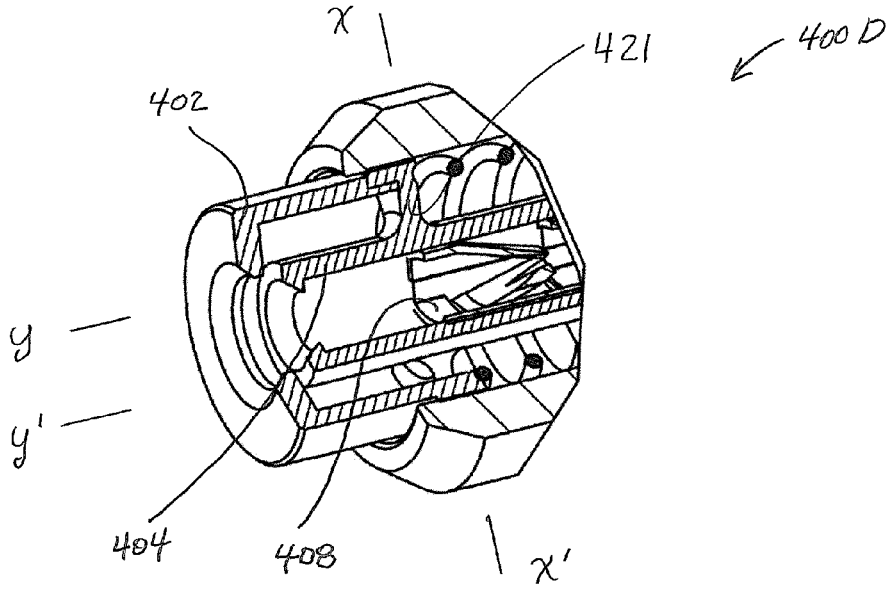

FIGS. 4C-D show perspective views 400C-D of the connector of FIGS. 4A-B. As seen in FIG. 4C and in the enlarged connector end of FIG. 4D, the plunger 404 has an interface 421 with the cap at a location in the x-y plane. However, the plunger does not have an interface with the cap at a location in the x'-y' plane.

Figure 4E:
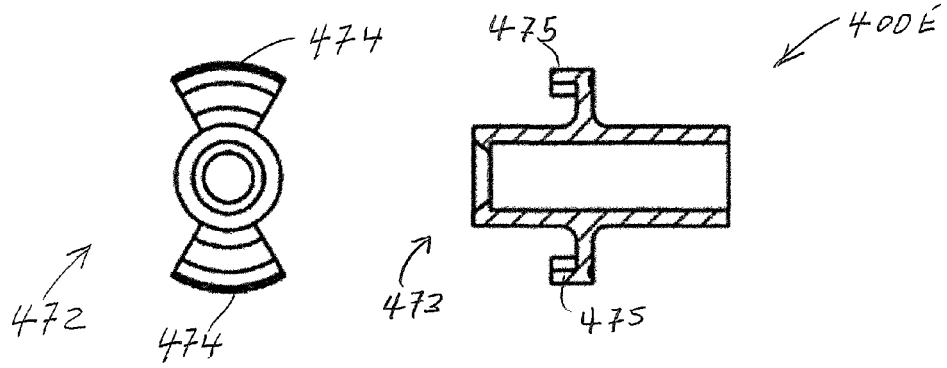

FIG. 4E explains this geometry 400E. Seen at left is an end view 472 of the plunger and seen at right is cross-sectional side view 473 of the plunger. The end view shows two generally opposed arc-shaped portions or tines 474 for interfacing with the cap 402. In the cross-sectional side view the arc-shaped interfaces appear as stacked rectangles 475.

Figure 4F:
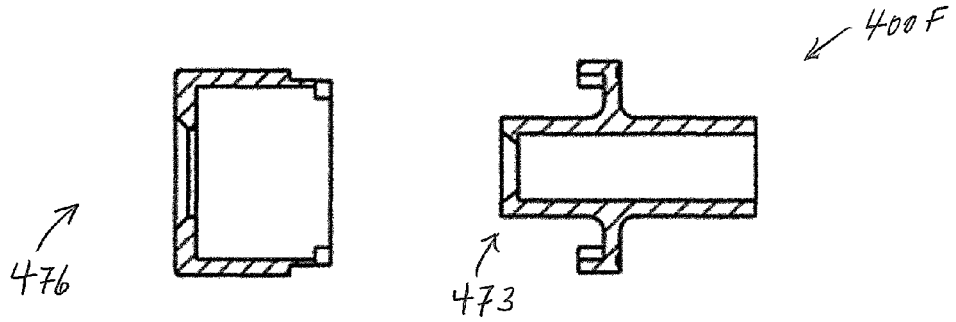
Figure 4G:
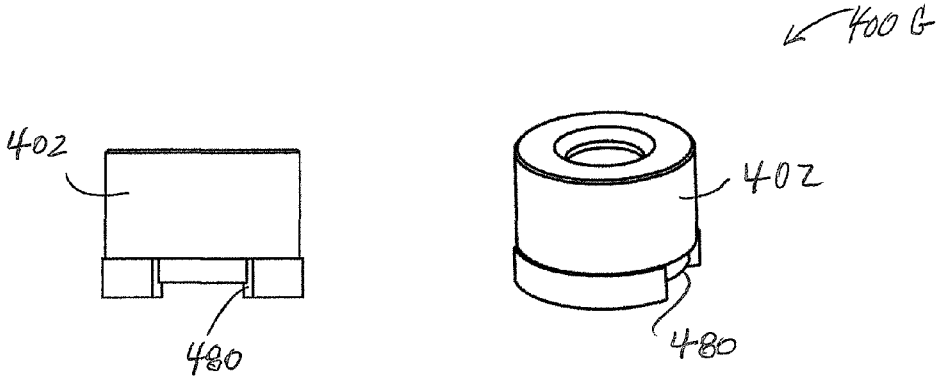

FIG. 4F shows the cap and plunger 400F. Seen at left is a cross-sectional side view of the cap 476 and seen at right is a cross-sectional side view 473 of the plunger. When mated, the cap receives the plunger (not shown) into arc-shaped cutouts 480 (See FIG. 4G) in the cap.

Figure 4H:
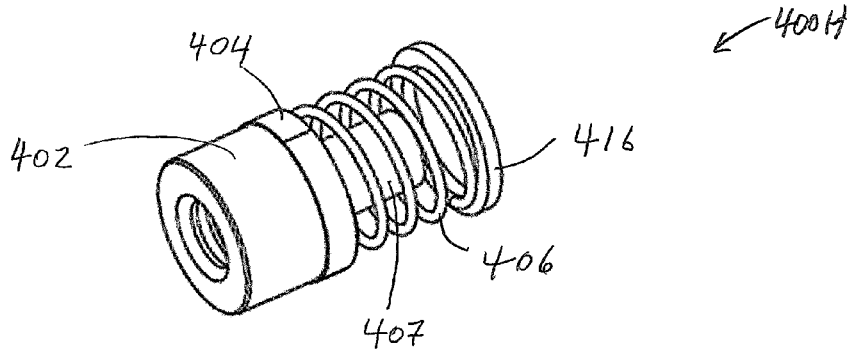

FIG. 4H shows a cap and plunger assembly 400H. In particular, the figure shows a cap 402 with an inserted plunger 404. The assembly of cap and plunger may be a notched cap that is received by the tines of a plunger or vice versa. In an embodiment, the cap notches 480 are between the plunger tines 474. A spring 406 is shown surrounding a trailing end of the plunger 407 and a ring or rim 416 is shown for supporting an immovable end of the spring 406.

FIGS. 5A-G show a moving nose female coaxial connector embodiment with a plunger that does not slide along the center pin 500A-G. In various embodiments the plunger is or includes a metal or electrical conductor.

Figure 5A:
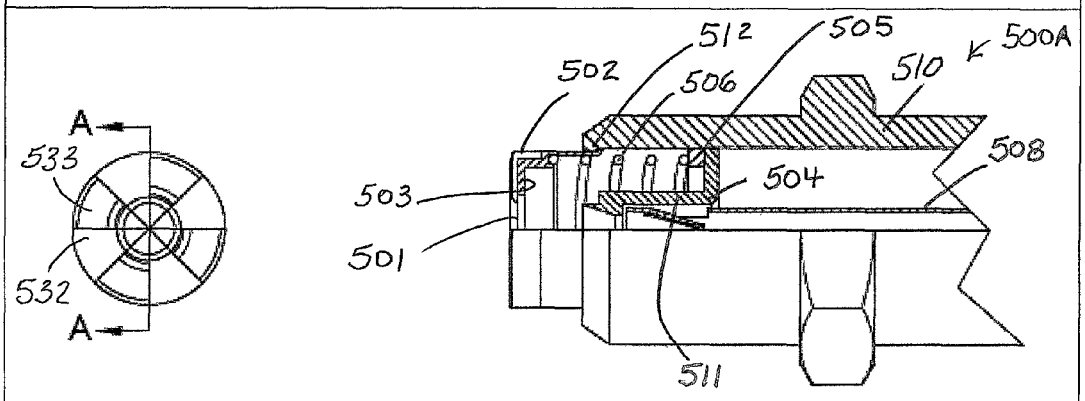
FIGS. 5A-G show another embodiment of the moving nose female connector of FIG. 1A.
Figure 5B:
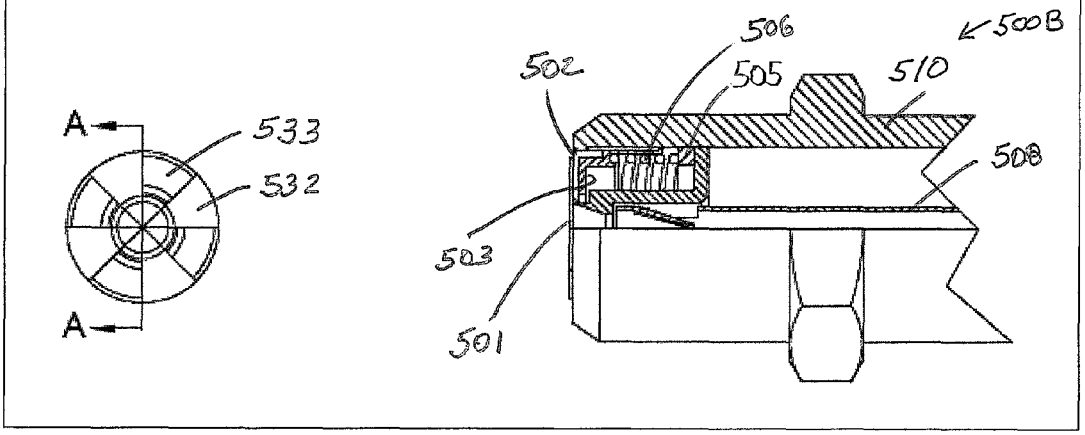
Figure 5C:
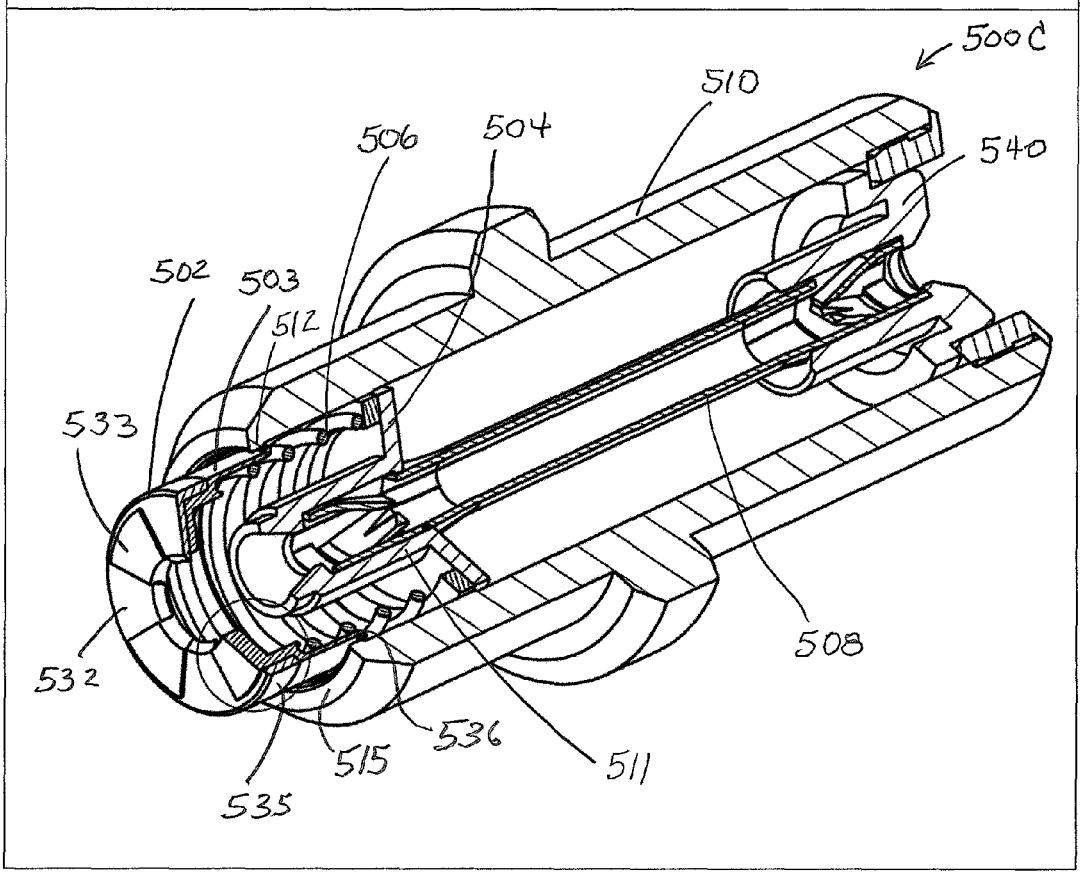

As seen in FIGS. 5A-C a center pin 508 is supported by two fixed insulators 504, 540 (See FIG. 5C). Surrounding a fixed insulator post 511 is a spring 506. In some embodiments the spring is conductive, a conductive spring rest 505 is fixed to the body 510, and the spring is seated on this rest.

The spring 506 urges a plunger 503 to project from a body mouth 515. Mounted to a face of the plunger 533 is a mask 502. An entryway for the center conductor of a mating connector is provided 501 via the plunger and the mask. The mask in the form of a disc with a central window 575 and a plurality of side windows 574 around the central window (See FIG. 5E). In some embodiments there are four side windows. Between the side windows are truncated pie shaped segments 532. The disc may include a skirt 535 that encircles and is affixed to the plunger.

A body mouth 515 inwardly directed rim or ring 512 provides a stop for contacting a plunger rim or ring 536. Although the spring tends to eject the plunger 503, the stop prevents the plunger from being ejected from the body mouth.

Figure 5D:
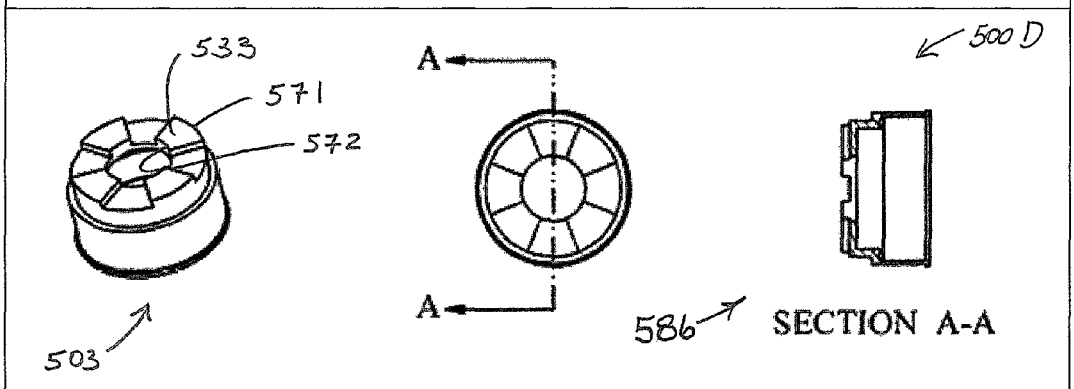
Figure 5E:
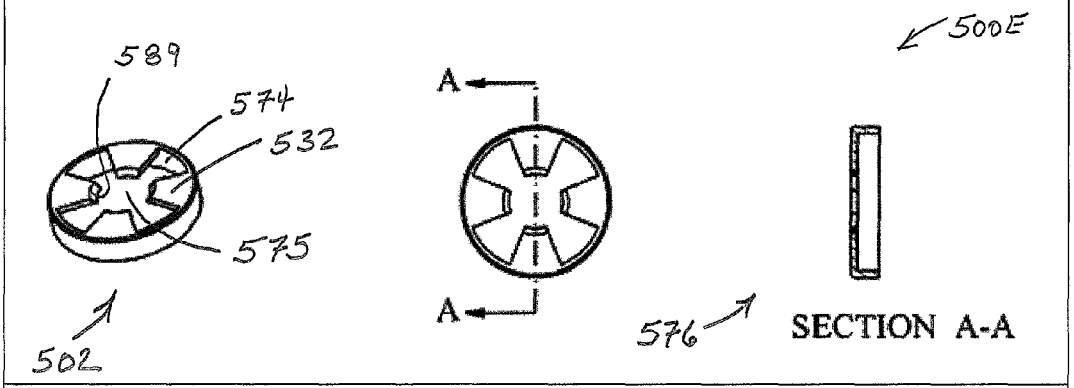
Figure 5F:
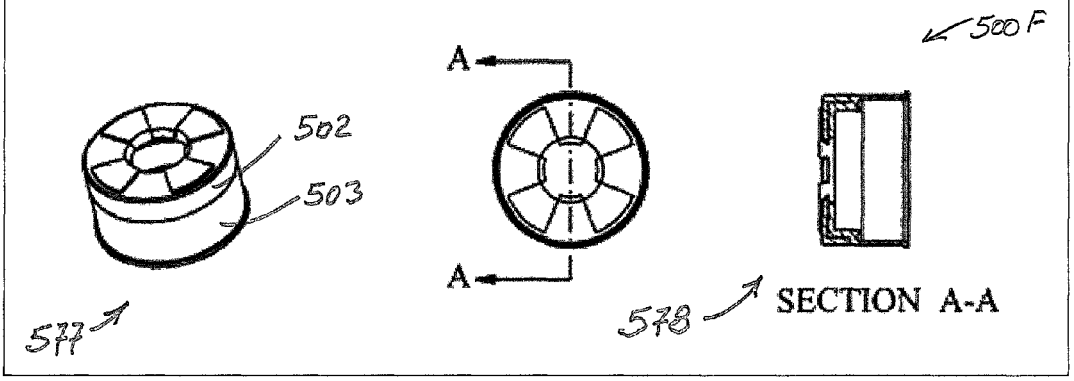

FIGS. 5D-F show detailed views of the plunger and mask 500D-F. In FIG. 5D, the plunger is shown in perspective at left 503. As seen, there are raised surfaces 533 on the face of the plunger. Four raised surfaces are shown. Section lines A-A indicate how the plunger is cut to show a section 586. Notably, the raised sections have a truncated pie shape extending between an outer circumference defining an outer diameter 571 and an inner circumference defining an inner diameter 572. The inner diameter is that of the central window. In various embodiments, the outer diameter is selected to provide a snug fit with the disk skirt 535.

In FIG. 5E the mask is shown in perspective at left 502. Section lines A-A indicate how the mask is cut to show a section 576. As seen, there are side windows 574 and a central window 575. The side windows are configured to fit over the raised surfaces 533 of the plunger 503. Notably, the raised surfaces of the plunger are surrounded on three sides by the mask side window. The fourth side of the raised surface of the plunger is not within the mask side window. Rather, this side of the raised surface forms a portion inner diameter 572.

The central window 575 is formed by a piece-wise construct that is the truncated end of the pie-shaped mask segments 589. The central window provides an entryway for the center conductor of a male connector or the center conductor of a coaxial cable.

FIG. 5F shows an assembly 577 including a mask 502 and a plunger 503. Section lines A-A indicate how the assembly is cut to show a section 578.

Figure 5G:
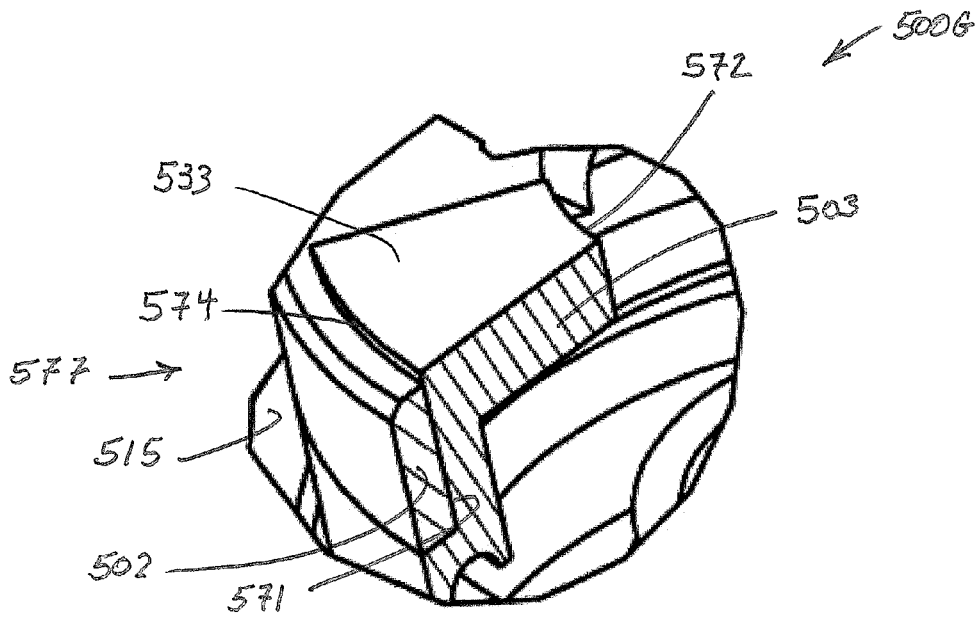

FIG. 5G shows a detailed view of the mask 502 installed on a plunger 503. As seen, the mask and plunger assembly 577 protrude from a connector body mouth 515. The mask encircles the plunger and fits over the plunger such that the raised surfaces 533 of the plunger project through the side windows 574 of the mask.

FIGS. 6A-G show another moving nose female coaxial connector embodiment with a plunger that does not slide along the center pin 600A-G. In various embodiments the plunger is or includes a metal or electrical conductor.

Figure 6A:
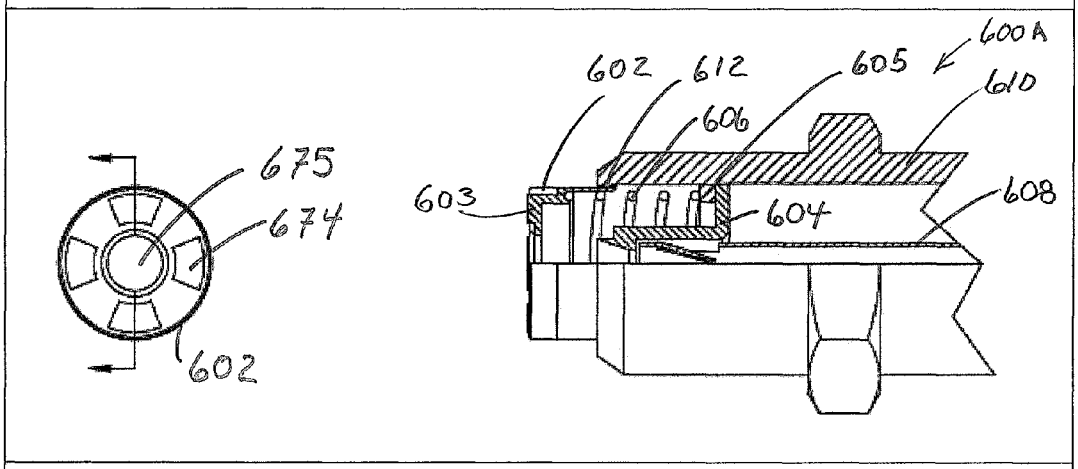
FIGS. 6A-G show another embodiment of the moving nose female connector of FIG. 1A.
Figure 6B:
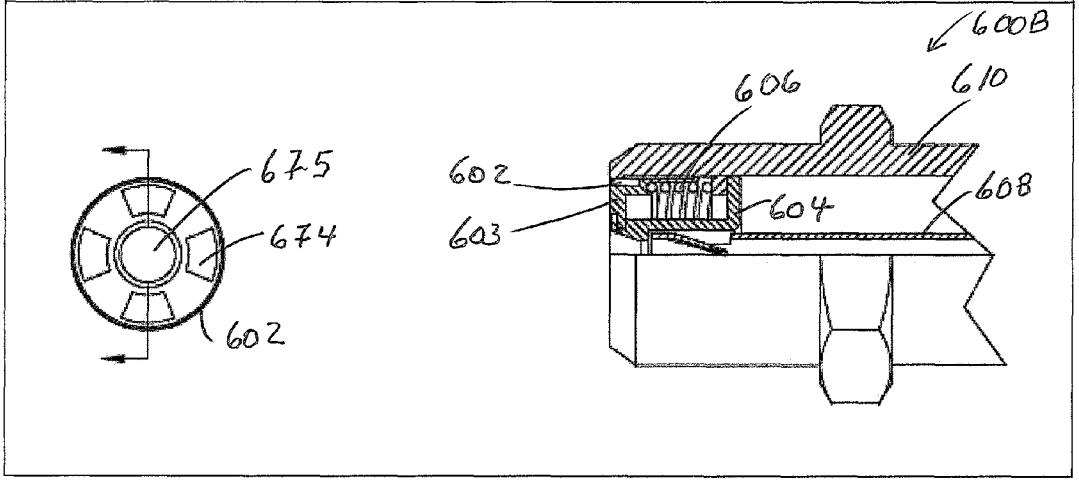
Figure 6C:
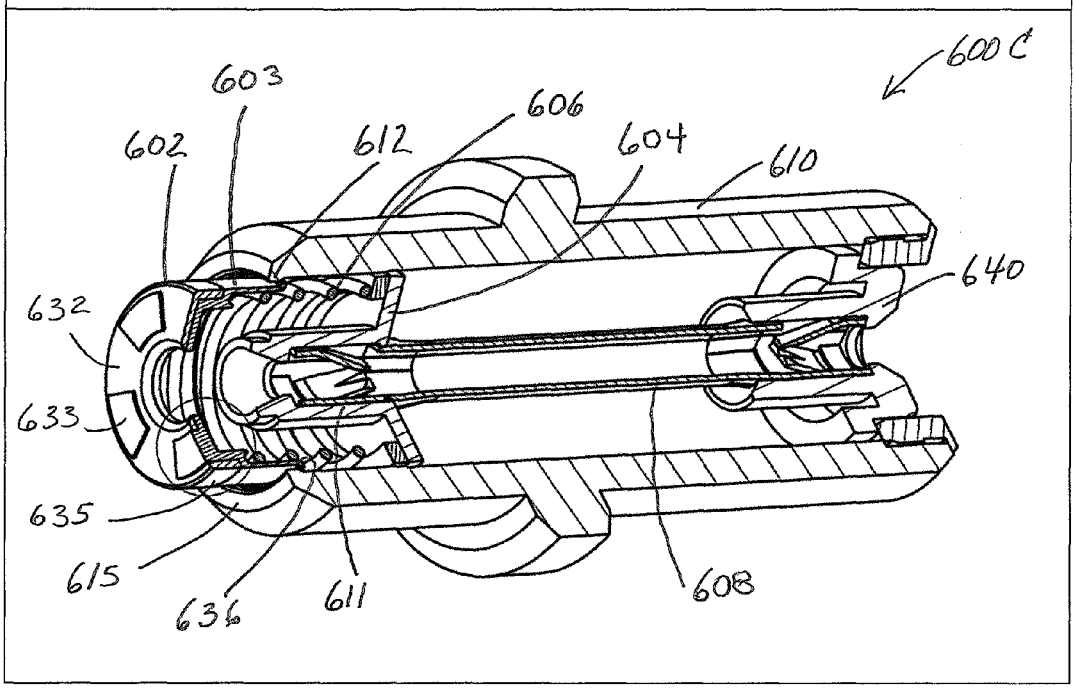

As seen in FIGS. 6A-C a center pin 608 is supported by two fixed insulators 604, 640 (See FIG. 6C). Surrounding a fixed insulator post 611 is a spring 606. In some embodiments the spring is conductive, a conductive spring rest 605 is fixed to the body 610, and the spring is seated on this rest.

The spring 606 urges a plunger 603 to project from a body mouth 615. Mounted to a face of the plunger 633 is a mask 602. The mask in the form of a disc with a central window 675 and a plurality of side windows 674 around the central window (See FIG. 6E). In some embodiments there are four side windows. Between the side windows are truncated pie shaped segments 632. The disc may include a skirt 635 that encircles and is affixed to the plunger.

A body mouth 615 inwardly directed rim or ring 612 provides a stop for contacting a plunger rim or ring 636. Although the spring tends to eject the plunger 603, the stop prevents the plunger from being ejected from the body mouth.

Figure 6D:
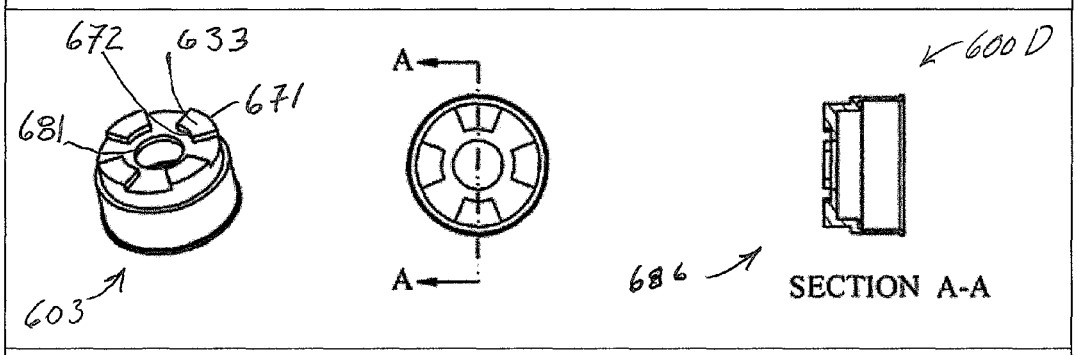
Figure 6E:
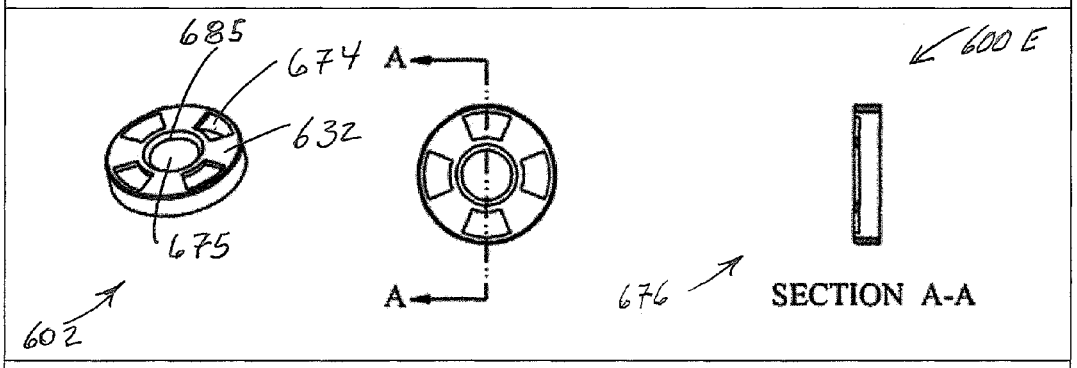
Figure 6F:
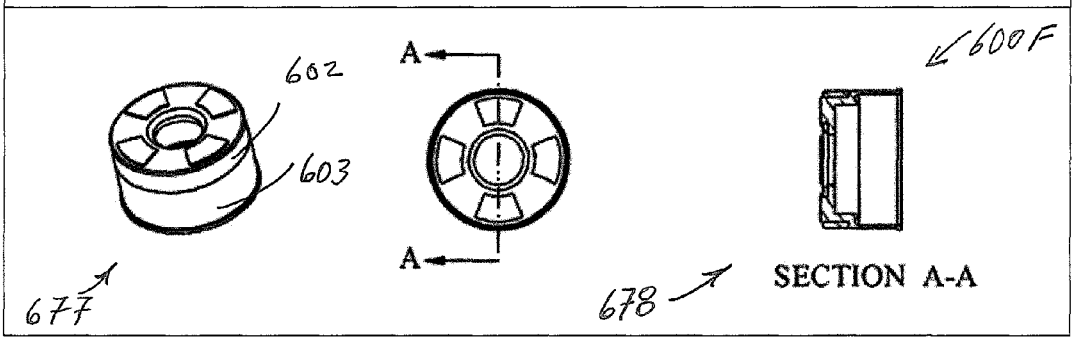

FIGS. 6D-F show detailed views of the plunger and mask 600D-F. In FIG. 6D, the plunger is shown in perspective at left 603. As seen, there are raised surfaces 633 on the face of the plunger. Four raised surfaces surrounding a central opening 681 are shown. Section lines A-A indicate how the plunger is cut to show a section 686. Notably, the raised sections have a truncated pie shape extending between an outer circumference defining an outer diameter 671 and an inner circumference defining an inner diameter 672. The inner diameter is that of the central window. In various embodiments, the outer diameter of the plunger 688 (See FIG. 6G) is selected to provide a snug fit with the disk skirt 635.

In FIG. 6E the mask is shown in perspective at left 602. Section lines A-A indicate how the mask is cut to show a section 676. As seen, there are side windows 674 and a central window 675. The side windows are configured to fit over the raised surfaces 633 of the plunger 603. Notably, the raised surfaces of the plunger are surrounded by the mask side window. That is to say, the four sides of the raised plunger surface are surrounded by the mask side window.

The central window 675 is formed by a continuous web of the mask 685 that encircles the window. The central window provides an entryway for the center conductor of a male connector or the center conductor of a coaxial cable.

FIG. 6F shows an assembly 677 including a mask 602 and a plunger 603. Section lines A-A indicate how the assembly is cut to show a section 678.

Figure 6G:
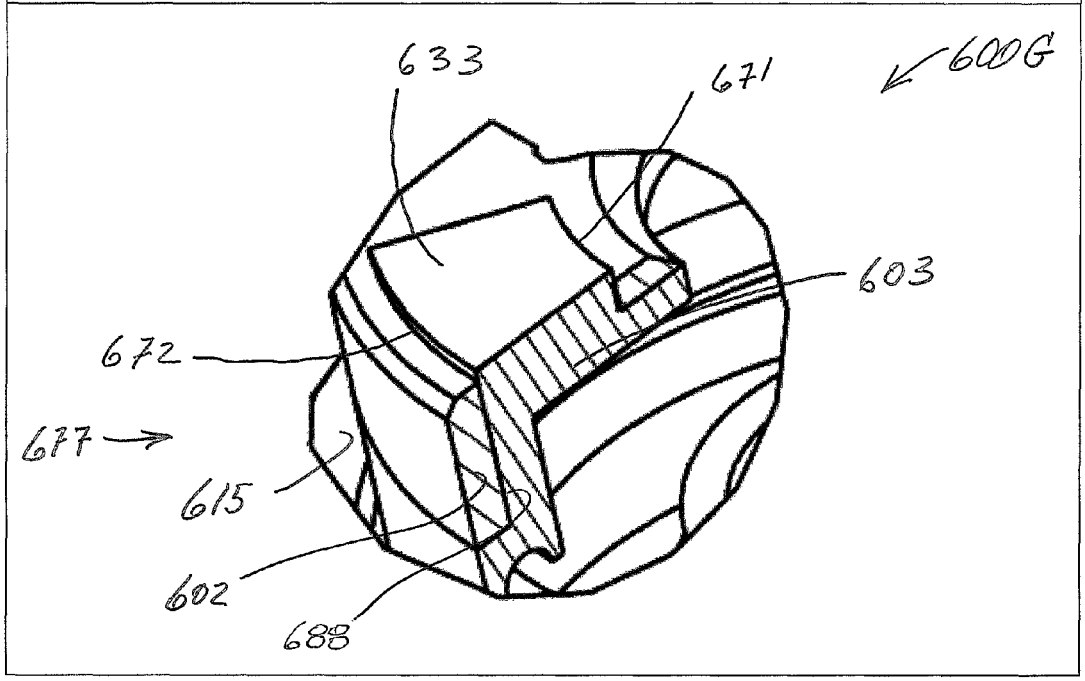

FIG. 6G shows a detailed view of the mask 602 installed on the plunger 603. As seen, the mask and plunger assembly 677 protrude from a connector body mouth 615. The mask encircles the plunger and fits over the plunger such that the raised surfaces 633 of the plunger project through the side windows 674 of the mask.

Figure 7A:
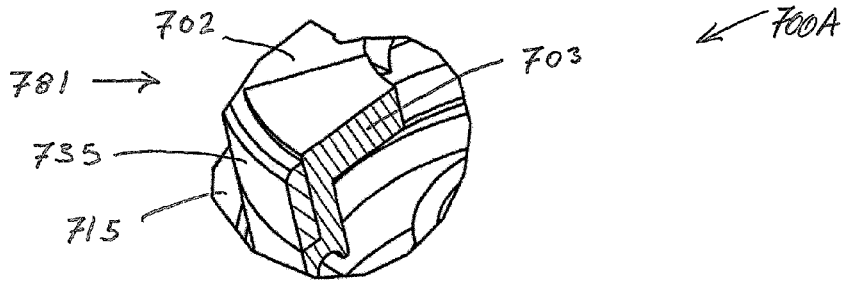
FIGS. 7A-C show fixations of the mask to the plunger useful with the connector of FIGS. 5A-G and FIGS. 6A-G.
Figure 7B:
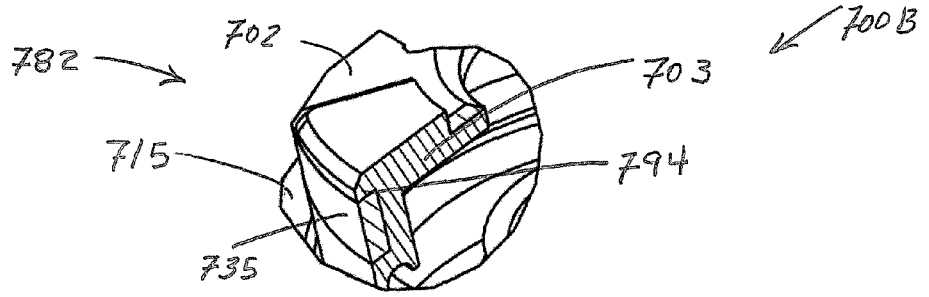
Figure 7C:
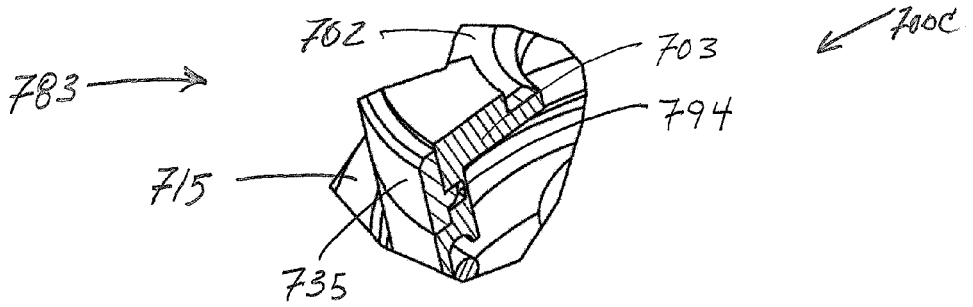

FIGS. 7A-C show mask attachment methods 700A-C. These mask attachment methods are applicable to the connectors of FIGS. 5A-G and FIGS. 6A-G.

In FIG. 7A, a plunger 703 and mask 702 assembly 781 protrudes from a connector body mouth 715. Here, the mask skirt 735 is configured to attach to the plunger 703. For example, the mask skirt may have a diameter that results in an interference fit with the plunger outer diameter.

In FIG. 7B, a plunger 703 and mask 702 assembly 782 protrudes from a connector body mouth 715. Here, the mask skirt 735 is configured to attach to the plunger 703. For example, a groove 794 around the plunger may provide a means for retaining the mask as by holding the mask skirt.

In FIG. 7C, a plunger 703 and mask 702 assembly 783 protrudes from a connector body mouth 715. Here, the mask skirt 735 is configured to attach to the plunger 703. For example, the mask skirt may have a tongue such that a tongue and groove connection between the skirt and the mask 794 provides a means for attaching the mask to the skirt.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What the invention claimed is:

1. A coaxial cable connector comprising:

a connector body including a center pin for receiving the center conductor of a male connector;

a plunger urged by a spring to protrude from a connector body mouth at a connector body first end;

opposed first and second spring ends, the first spring end resting on a spring base affixed to the body and the second spring end resting on the plunger;

the spring surrounding an insulated portion of the center conductor wherein the spring is spaced apart from the insulated center conductor;

a connector body second end opposite the connector body first end and a connector middle therebetween, the spring base being located between the connector first end and the connector middle;

when the connector is not mated, the center pin is masked from extraneous signals, the spring is extended, and the plunger protrudes from the connector body mouth; and, when the connector is mated, the center pin receives the center conductor of a male connector, the spring is compressed, and the plunger is moved toward the second end of the connector.

2. The connector of claim 1 further including:

a plunger flange located about midway between opposed plunger ends;

a cap that abuts the plunger flange; and, a protruding nose formed by the cap and the plunger.

3. The connector of claim 2 further comprising:

a cap aperture for receiving the center conductor of a male connector;

the aperture large enough to allow insertion of the male connector center conductor and small enough to mask the center conductor from extraneous radio frequency signals.

4. The connector of claim 3 wherein:

the cap aperture has a minimum diameter that is 2 to 4 times the diameter of the male connector center conductor.

5. The connector of claim 4 wherein the cap is an electrical conductor and the spring base is a body shoulder.

6. The connector of claim 1 wherein the plunger passes through the spring base when the connector is mated with a male connector.

7. The connector of claim 2 further comprising;

a center conductor entryway providing access to the center pin, the entryway including an aperture in the cap having a diameter about equal to that of an aperture in the plunger.

8. The connector of claim 7 wherein the plunger slides along the center conductor when the spring is compressed.

9. The connector of claim 7 wherein the plunger is an electrical insulator.

10. The connector of claim 1 further comprising:

the spring inserted in the plunger; and the spring surrounding an insulator that is fixed with respect to the center conductor.

11. The connector of claim 10 further comprising:

raised surfaces on a face of the plunger;

a mask fitted to the plunger face; and, the raised surfaces protruding from openings in the mask.

12. The connector of claim 11 further comprising:

a mask skirt that encircles the plunger.

13. The connector of claim 12 wherein the mask is not an electrical conductor.

14. The connector of claim 13 wherein the plunger is an electrical conductor.

* * * * *